US010819039B2

(12) United States Patent
Choon et al.

(10) Patent No.: US 10,819,039 B2
(45) Date of Patent: Oct. 27, 2020

(54) ANTENNA SYSTEM AND COMMUNICATION TERMINAL

(71) Applicant: AAC Technologies Pte. Ltd., Singapore (SG)

(72) Inventors: Tan Yew Choon, Singapore (SG); Ng Guan Hong, Singapore (SG); Tay Yew Siow, Singapore (SG)

(73) Assignee: AAC Technologies Pte. Ltd., Singapore (SG)

( * ) Notice: Subject to any disclaimer, the term of this patent is extended or adjusted under 35 U.S.C. 154(b) by 34 days.

(21) Appl. No.: 16/296,484

(22) Filed: Mar. 8, 2019

(65) Prior Publication Data

US 2020/0136267 A1 Apr. 30, 2020

(30) Foreign Application Priority Data

Oct. 25, 2018 (CN) ..... 2018 1 1253306

(51) Int. Cl.

| | |
|---|---|
| ***H01Q 21/00*** | (2006.01) |
| ***H01Q 5/35*** | (2015.01) |
| ***H01Q 1/22*** | (2006.01) |
| ***H01Q 21/06*** | (2006.01) |

(52) U.S. Cl.

CPC ..... *H01Q 21/0025* (2013.01); *H01Q 1/22* (2013.01); *H01Q 5/35* (2015.01); *H01Q 21/065* (2013.01)

(58) Field of Classification Search

CPC .. H01Q 1/36; H01Q 1/22; H01Q 1/50; H01Q 5/35; H01Q 21/0025; H01Q 21/293; H01Q 23/00; H01Q 21/061; H01Q 21/00; H04M 1/026; H04M 1/03; H04R 1/403

See application file for complete search history.

(56) References Cited

U.S. PATENT DOCUMENTS

| | | | | |
|---|---|---|---|---|
| 10,263,318 | B2 * | 4/2019 | Yan | H01Q 1/243 |
| 2016/0301143 | A1 * | 10/2016 | Cao | H01P 5/12 |
| 2019/0165478 | A1 * | 5/2019 | Jo | H01Q 1/243 |
| 2019/0245262 | A1 * | 8/2019 | Xia | H04M 1/026 |

FOREIGN PATENT DOCUMENTS

| | | | |
|---|---|---|---|
| CN | 105322298 | A1 | 2/2018 |

OTHER PUBLICATIONS

PCT search report dated Jan. 8, 2020 by SIPO in related PCT Patent Application No. PCT/CN2019/109027 (9 Pages).

* cited by examiner

*Primary Examiner* — Thai Pham
(74) *Attorney, Agent, or Firm* — IPro, PLLC; Na Xu

(57) ABSTRACT

The present invention discloses an antenna system including a sub-array rectangular speaker having a metal substrate and a circuit board with 4 electrically connected sub-boards, 4 insolate layers and 4 feeding components. The sub-board includes a first feed point and a second feed point for electrically connecting to corresponding feeding components. Each of the speakers includes sidewalls and rigid walls for electrically connected to the first and second feed points. The present invention further provides a communication terminal using such an antenna.

9 Claims, 11 Drawing Sheets

ANTENNA SYSTEM AND COMMUNICATION TERMINAL

FIELD OF THE PRESENT DISCLOSURE

The invention relates to communication technologies, especially to an antenna system and a communication terminal using such an antenna system.

DESCRIPTION OF RELATED ART

With the development of mobile communication technology, cell phone, PAD and laptop etc gradually become the indispensable electronic product in life. Moreover, this type of electronic product is updated to add antenna system to make it become electronic communication product with the communication function.

5G is the focus of research and development in the industry all over the world. Its three main application highlights are: enhanced mobile broadband, large-scale machine communication, high reliability, and low delay communication. Three application highlights correspond respectively to different key indicators, wherein the user peak speed in the enhanced mobile bandwidth is 20 Gbps and the minimum user experience speed is 100 Mbps. The unique characteristics of the millimeter wave, i.e., high carrier frequency and large bandwidth are the main aspects to realize 5G ultra-high data transmission speed. Therefore, the rich bandwidth resources in the millimeter wave band provide the guarantee for high-speed transmission.

However, due to the intense space loss of electromagnetic waves in this frequency band of millimeter wave, wireless communication antenna system using millimeter wave band needs phased array architecture. The phase of each array element is distributed according to a certain rule through a phase shifter, so as to form a high gain wave beam, and the beam is scanned in a certain spatial range by changing the phase shift. However, if line-of-sight communication cannot be maintained between the transmitter and receiver of the antenna system in the millimeter wave band, the communication link is easily broken. If the bandwidth of the frequency band covered in the beam range is limited, the reliability of the antenna system shall be affected.

However, it is necessary to provide one kind new antenna system and communication terminal to solve the problem mentioned above.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

FIG. 6*a* and FIG. 6*b* are the characteristic curve graph of S parameters of subarray rectangular speaker element of FIG. 1, in which FIG. 6*a* is the curve graph of the reflection coefficient of all rectangular speaker of subarray rectangular speaker element FIG. 6*b* is curve graph of insulation of one rectangular speaker with other three rectangular speaker of subarray rectangular speaker element.

FIG. 11*a* and FIG. 11*b* are characteristic curve graph of S parameters of an antenna system of FIG. 8, in which FIG. 11*a* is the curve graph of reflection-coefficient of all rectangular speaker of the antenna system; FIG. 11*b* is the curve graph of insulation of one rectangular speaker with other fifteen rectangular speaker of antenna system.

FIG. 12*a* is the gain curve graph in Phi=0° plane; FIG. 12*b* is the gain curve graph in Phi=90° plane.

FIG. 16*a* is the gain curve graph in Phi=0° plan; FIG. 16*b* is the gain curve graph in Phi=90° plan.

DETAILED DESCRIPTION OF THE EXEMPLARY EMBODIMENTS

Figure 1:
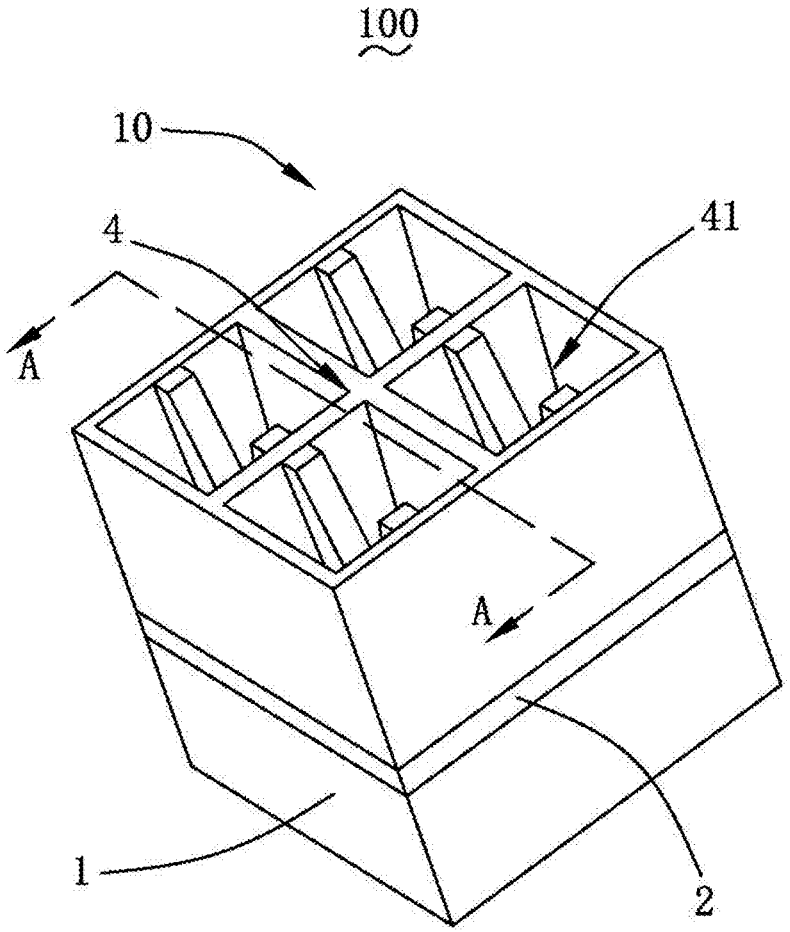
FIG. 1 is the structural representation of a subarray rectangular speaker element of an antenna system of the invention.
Figure 2:
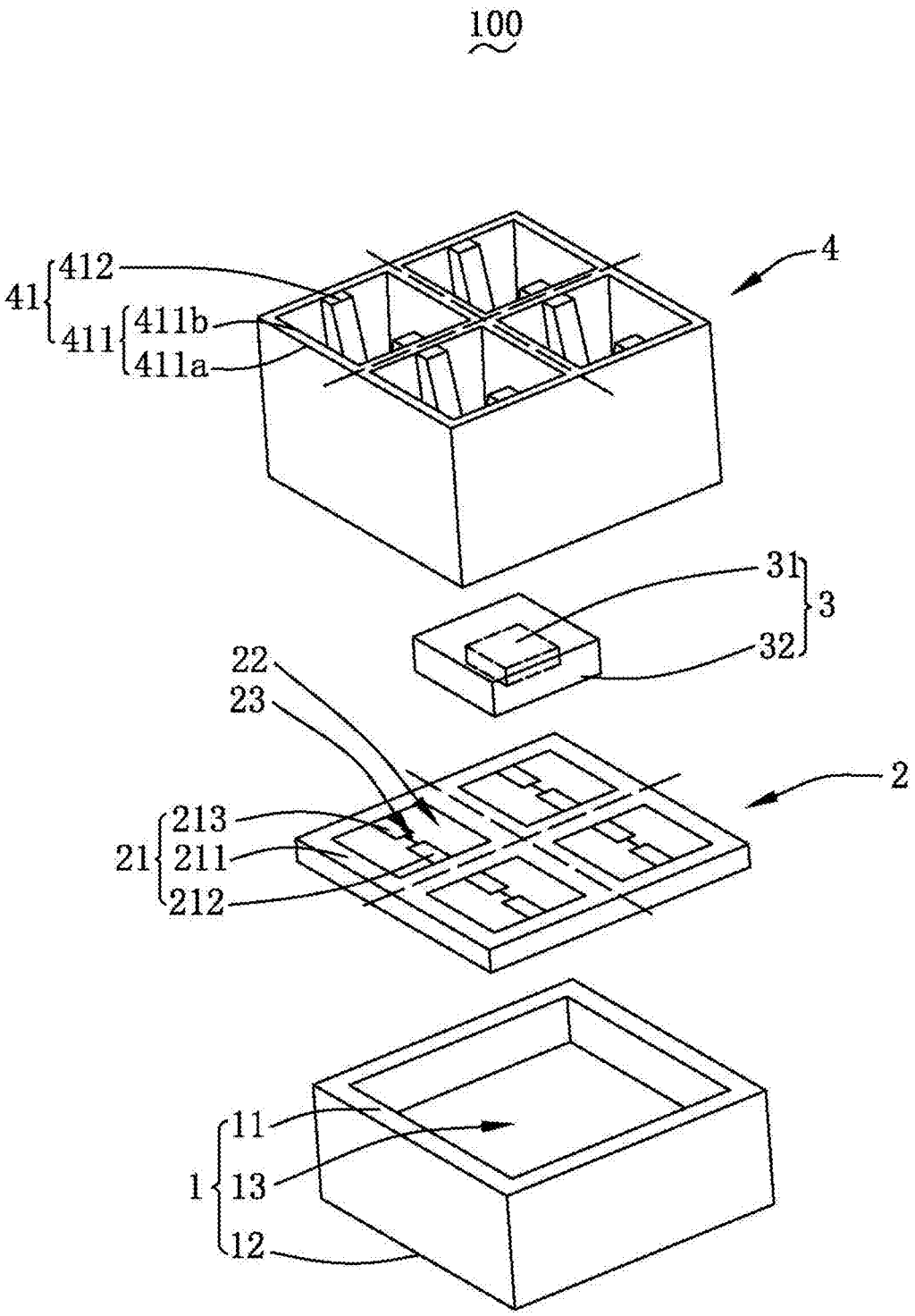
FIG. 2 is the decomposition graph of a three-dimensional structure of a subarray rectangular speaker element of an antenna system of the invention.
Figure 3:
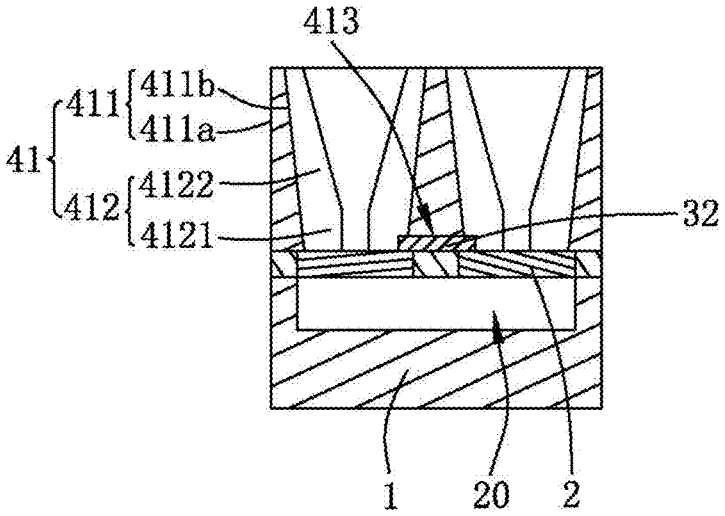
FIG. 3 is the sectional view along A-A line in FIG. 1.
Figure 4:
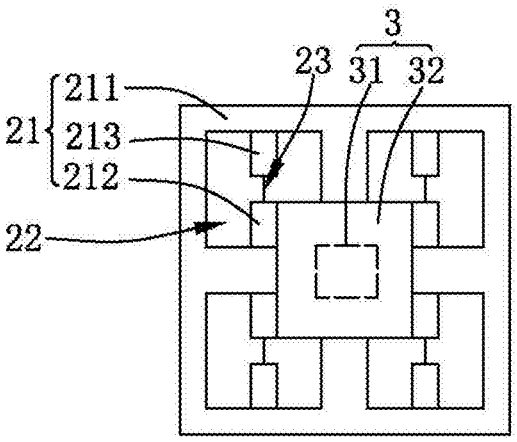
FIG. 4 is the vertical view of the subarray rectangular speaker element of an antenna system of the invention.

The present disclosure hereinafter is described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Please refer to FIGS. 1-5. An antenna system 100 provided by the invention includes subarray rectangular speaker element 10. The subarray rectangular speaker element 10 includes a metal base 1, a PCB 2 superimposed on the metal base 1 and connected with the metal base 1 electronically, a phase-shifting unit 3 superimposed on the PCB 2 and connected with the PCB 2 electronically and a speaker element 4 superimposed on the PCB 2 and connected with the PCB 2 electronically.

The metal base 1 shows rectangular three-dimensional structure, such as cuboid structure. The metal base 1 includes a top surface 11, a bottom surface 12 opposite to the top surface 11 and a carinal cavity 13 depressing from the top surface 11 to the bottom surface 12.

The PCB 2 superimposed and set on the top surface 11 of the metal base 1 covers the carinal cavity 13 completely. The circuit board 2 is connected with the metal base 1 electronically. The circuit board 2 and the metal base 1 together enclose one space of the carinal cavity 13.

The circuit board 2 includes four 2*2 matrix distributed and interconnected sub-circuit boards 21.

In the embodiment, the sub-circuit board 21 is rectangular. Each of the sub-circuit boards 21 includes four conductive arms 211 connected from beginning to end and forming a rectangular ring and a first feed point end 212 and a second feed point end 213. Four conductive arm 211 encloses and forms carinal cavity 22. The first feed point end 212 and the second feed point end 213 extend vertically from the center of two opposite conductive arm 211 to the direction of the carinal cavity 22. The first feed point end 212, and the second feed point end 213 forms intervally a feed point port 23 of the subarray rectangular speaker element 10. Two ends of the feed point port 23 are connected with the first feed point end 212 and the second feed point end 213 electronically.

The setting of the sub-circuit board 21 with the first feed point end 212 and the second feed point end 213 makes the carinal cavity 22 show similar H shape. The feed signal is fed by the feed point port 23.

The phase-shifting unit 3 includes a phase-shifting chip 31 superimposed on the center of the PCB 2 and connected with four sub-circuit boards 21 electronically. In the embodiment, the phase-shifting chip 31 is a four-core phase-shifting chip. The phase-shifting chip 31 provides phase difference for all speaker elements 4 and lead reflection-mode of an antenna system 100 within the needed covering angle to ensure that horizon communication between transmitter and receiver not to be interrupted to add overall gain. Concretely, the phase-shifting chip 31 is used to make phase of all rectangular speakers of speaker element 4 to be distributed according to specific regular pattern to form the wave beam of high gain and wave beam scan within certain space range through the change of phase shifting, Lead reflection mode of antenna system in the needed covering angle to ensure that horizon communication between transmitter and receiver utilizing the antenna system 100 not to be interrupted to improve the reliability.

Preferably, the phase-shifting unit 3 also includes metal shielding part 32 covered entirely on the phase-shifting chip 31. The setting of the metal shielding part 32 can reduce and even eliminate the interference of the phase-shifting chip 31 on rectangular speaker 41 to improve the reliability of communication.

The speaker element 4 includes four rectangular speaker 41 which are distributed in the 2*2 matrix. Each rectangular speaker 41 is superimposed and fixed on one sub-circuit board 21 and forms an electronic connection. In the embodiment, the rectangular speaker 4 is millimeter wave antenna speaker.

Each one rectangular speaker 41 includes four side walls 411 connected from beginning to end and two ridges 412 opposite to the inner side of two side walls 411. The side wall 411 is superimposed and connected electronically on the conductive arm 211. Two ridges 412 are superimposed respectively and connected electronically on the first feed point end 212, and the second feed point end 213.

Preferably, a side wall 411 of each rectangular speaker 41 includes external wall 411*a* and inner wall 411*b*. The external wall 411*a* is vertical with the circuit board 2. The inner wall 411*b* expands gradually from one side closing to the circuit board 2 to one side far away from the circuit board 2 to make the cross-sectional area of one end of the wall 411 closing to the circuit board 2 larger than that of one end of that far away from the circuit board 2. Besides, in the embodiment, the external outline enclosed by inner wall 411*b* of the rectangular speaker 41 is square. The setting of the structure as mentioned above makes the rectangular speaker 41 form one speaker-shaped structure.

A ridge 412 is fixed in the inner wall 411*b* of the side wall 411. Specifically, the ridge 412 includes fixed part 4121 connected with the sub-circuit board 21 and one extension part 4122 extending from the fixed part 4121 to the extension part 4122 from the side wall 411 away from one end of the circuit board 2. The extension part 4122 expands from one end closing to fixed part 4121 to one end away from the fixed part 4121 gradually to make the cross-sectional area of one end of the extension part 4122 closing to the fixed art 4121 larger than that of one end of that away from the fixed part 4121.

Escape part 413 set on a side wall 411 of the rectangular speaker 41 escapes the metal shielding part 32. The metal shielding part 32 is bound inside the shielding part 413 and connected with the side wall 411.

The above-mentioned subarray rectangular speaker element 10 forms 2*2 millimeter wave antenna system structure phased-array.

Preferably. In the embodiment, the metal base 1 coincides with the external orthographic outline on the circuit board 2 of a speaker element 4 with external outline of a circuit board 2, which are square.

Figure 6A:
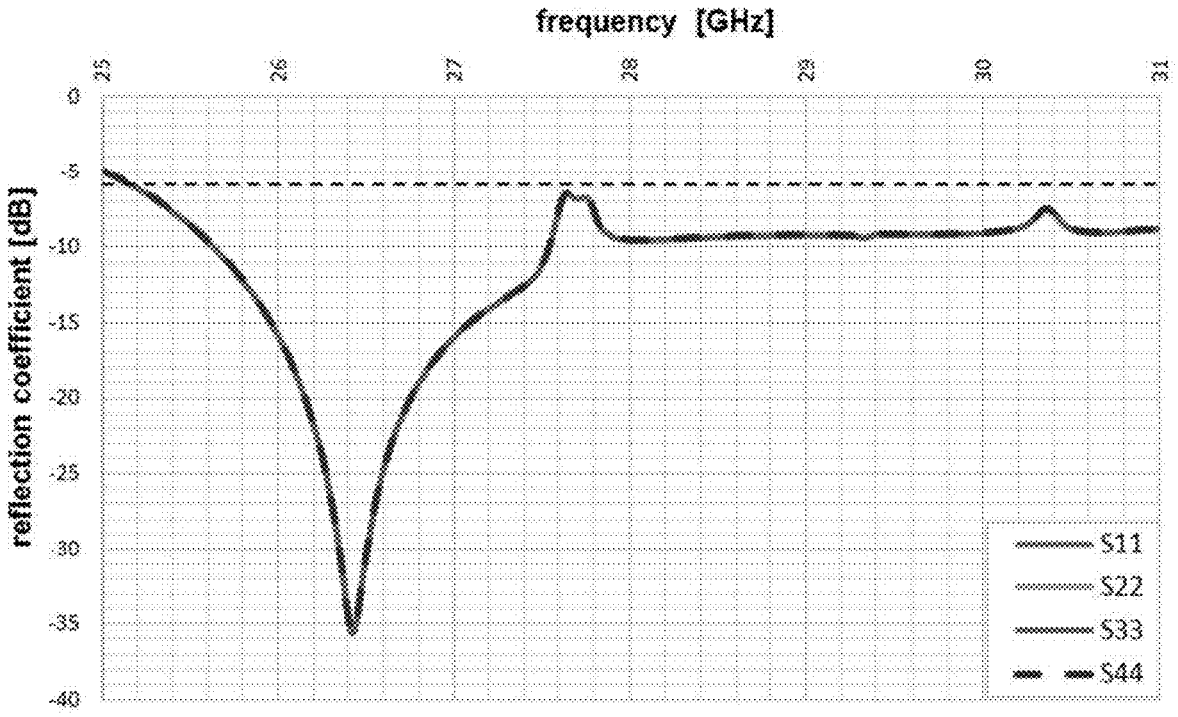
Figure 6B:
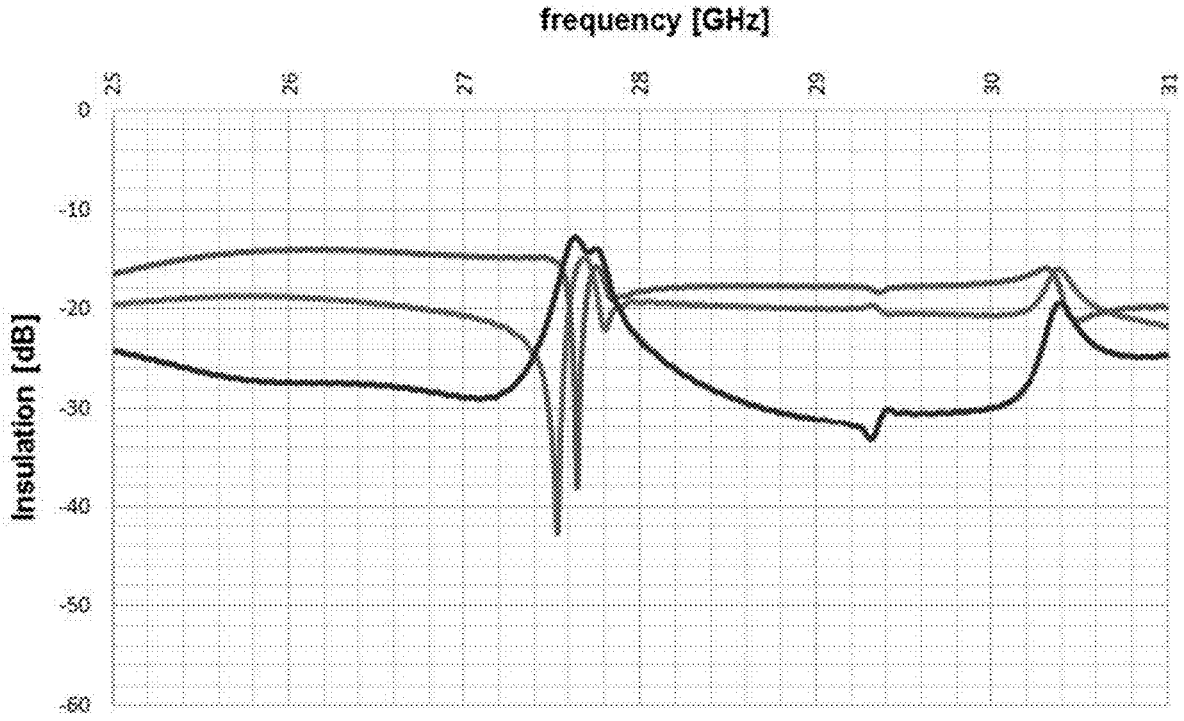
Figure 7:
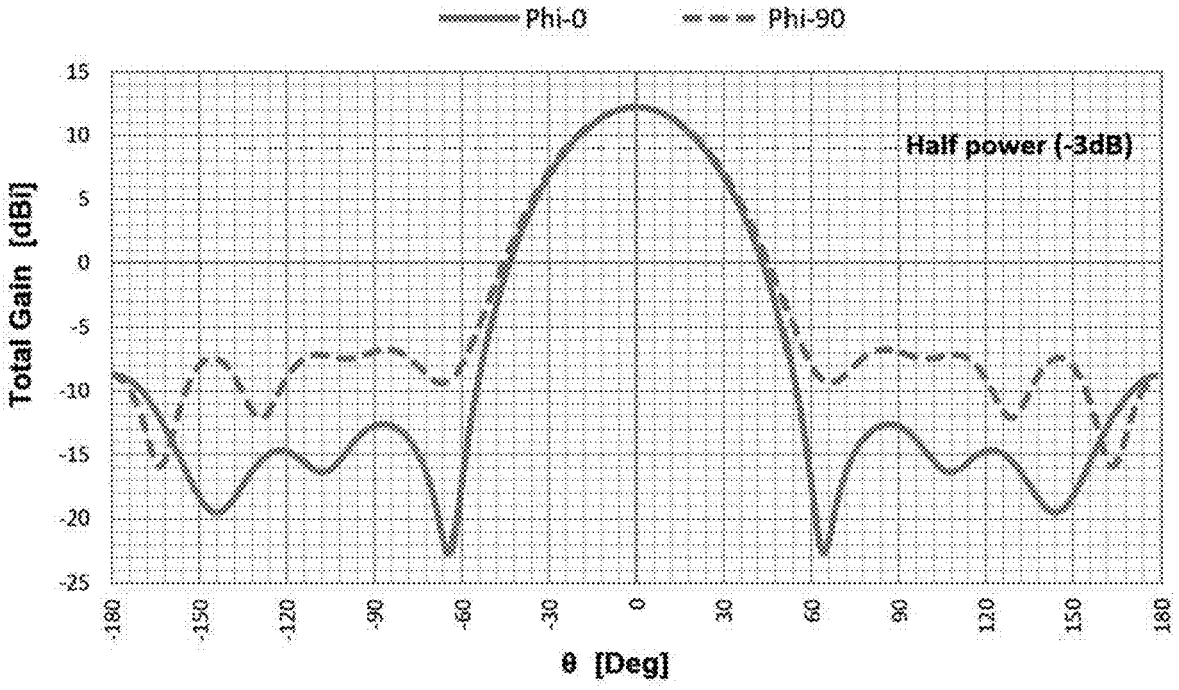
FIG. 7 is the gain curve graph in Phi=0° plane and Phi=90° plane when subarray rectangular speaker element of the invention is in 28 GHz, and all rectangular speakers feed at the same amplitude and phase.

Referring to FIG. 6*a*, FIG. 6*b* and FIG. 7, the reflection coefficient curves of four rectangular speaker are S11, S22, S33, S44 respectively. The reflection coefficient of all four rectangular speaker is less than −6 dB within 25.2 GHz-30 GHz. The width of broadband exceeds 5 GHz.

FIG. 6*b* is a curved graph of insulation of one rectangular speaker of subarray rectangular speaker element with other rectangular speaker. Within frequency range 25 GHz-31 GHz, insulation is kept under −12 dB. Under 28 GHz, insulation is lower than −18 dB.

Figure 5:
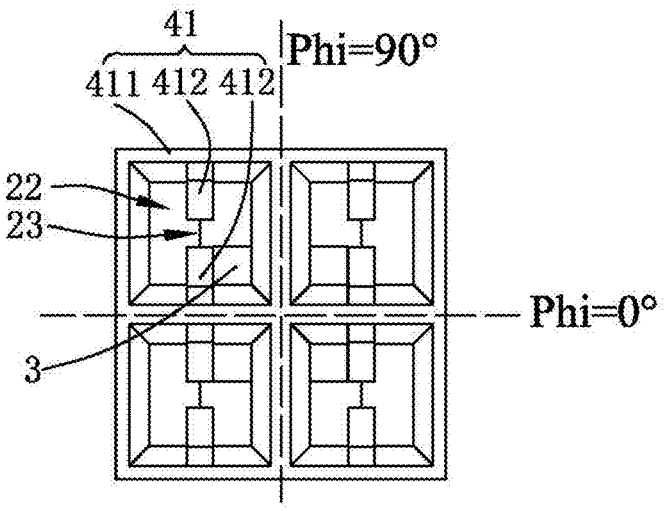
FIG. 5 is the vertical view of FIG. 1.

FIG. 7 is the gain curve graph when subarray rectangular speaker element of antenna system of invention is in 28 GHz and all rectangular speaker feed at the same range and phase, including gain curve graph in Phi=0° plan and gain curve graph in Phi=90° plan, among which Phi=0° plane and Phi=90° plane are the planes shown on FIG. 5. Under 28 GHz, the most significant gain of 2*2 rectangularly distributed millimeters wave antenna system of phased-array is 12.2 dBi. The width of HPBW on a plane is 48°. The width of the wave beam of half power on Phi=90° plane is 48°.

In the antenna system of the invention, a subarray rectangular speaker element 10 also includes set embodiment of different quantity. The subarray rectangular speaker element 10 includes N pieces. N pieces subarray rectangular speaker element 10 are distributed in a matrix and interconnected electronically to form phased array antenna system structure. The metal base 1 of the N pieces of the subarray rectangular speaker element 10 is an integral forming structure. The circuit board, 2 of the N pieces of the sub-array speaker antenna element, are integral forming structure.

Figure 8:
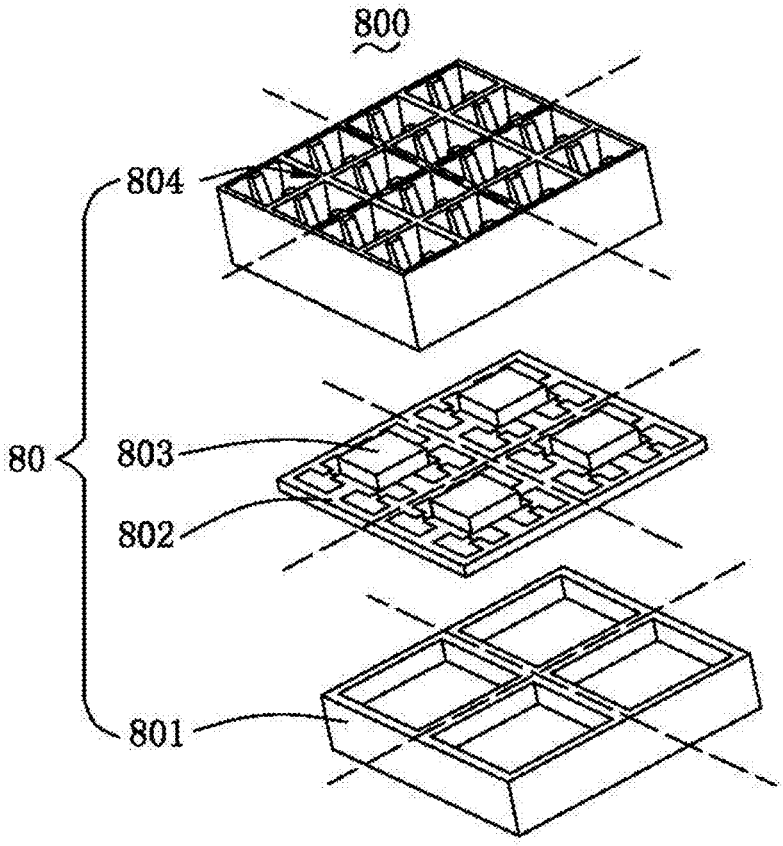
FIG. 8 is the decomposition graph of a three-dimensional structure of one of the embodiments of the antenna system of the invention.
Figure 9:
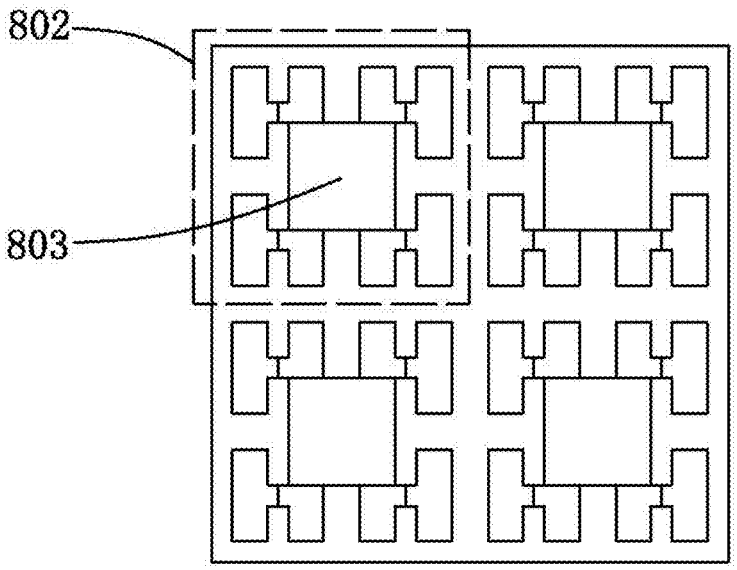
FIG. 9 is a vertical view of a partial structure of the antenna system of FIG. 8.
Figure 10:
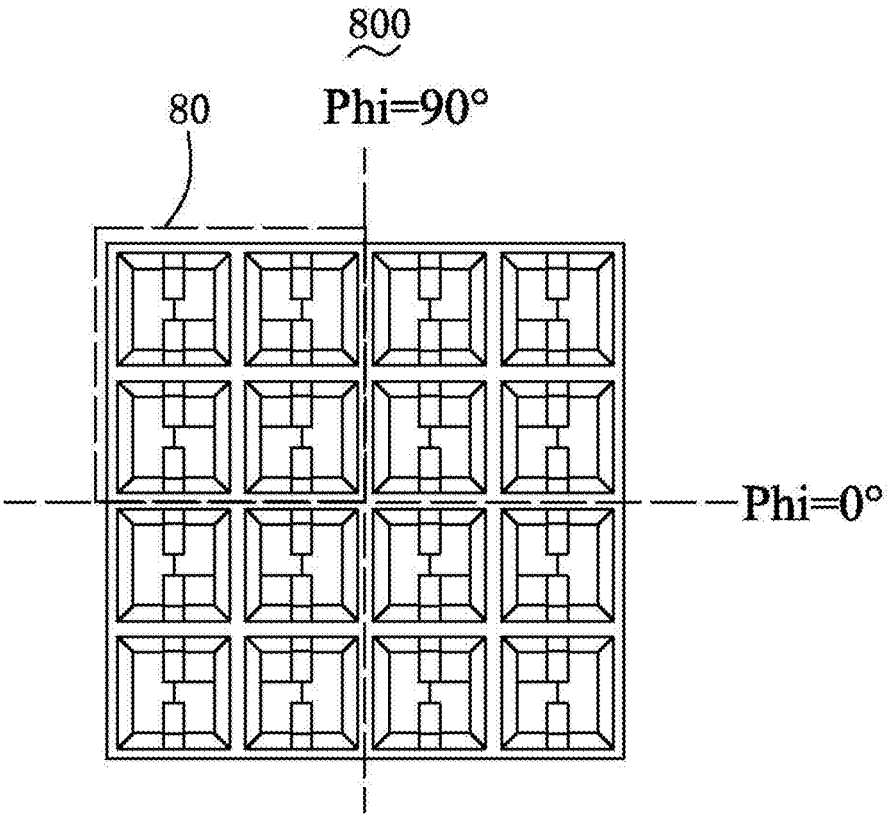
FIG. 10 is a vertical view of an antenna system of FIG. 8.

For example, phased-array system structure of 4*4 millimeter wave phase-array antenna system structure:

Shown as FIGS. 8-10, in which, FIG. 8 is three-dimensional decomposition graph of one kind of embodiment in the antenna system of the invention. FIG. 9 is a vertical view of a partial structure of the antenna system of FIG. 8. FIG. 10 is a vertical view of an antenna system of FIG. 8.

In the embodiment, the antenna system 800 includes four subarray rectangular speaker element 80 which are distributed in a matrix and interconnected electronically to form millimeter wave phase-controlling antenna system structure of 4*4 rectangular distribution. The subarray rectangular speaker element 80 namely is the subarray rectangular speaker element 10 of the embodiment mentioned above.

Preferably, a metal base 801 of a subarray rectangular speaker element 80 is an integral structure. A circuit board 802 of four subarray rectangular speaker element 80 is an integral forming structure. Four phase-shifting unit 803 are superimposed respectively on the circuit board 802. Four speaker elements 804 are superimposed on four circuit board 802 and connected electronically. The structures of the metal base 801, the circuit board 802, the phase-shifting unit 803 and the speaker element 804 is the same as the corresponding structure of subarray rectangular speaker element of above-mentioned 2*2 rectangular-distributed millimeter waves phased-array antenna system structure.

Figure 11A:
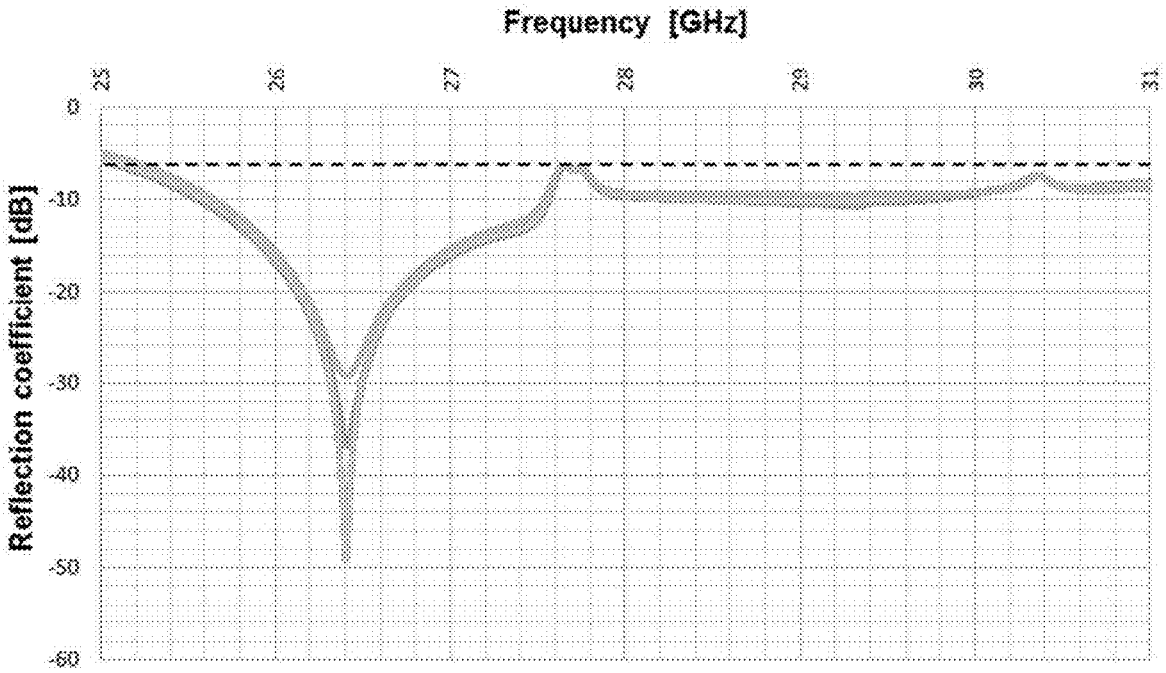
Figure 11B:
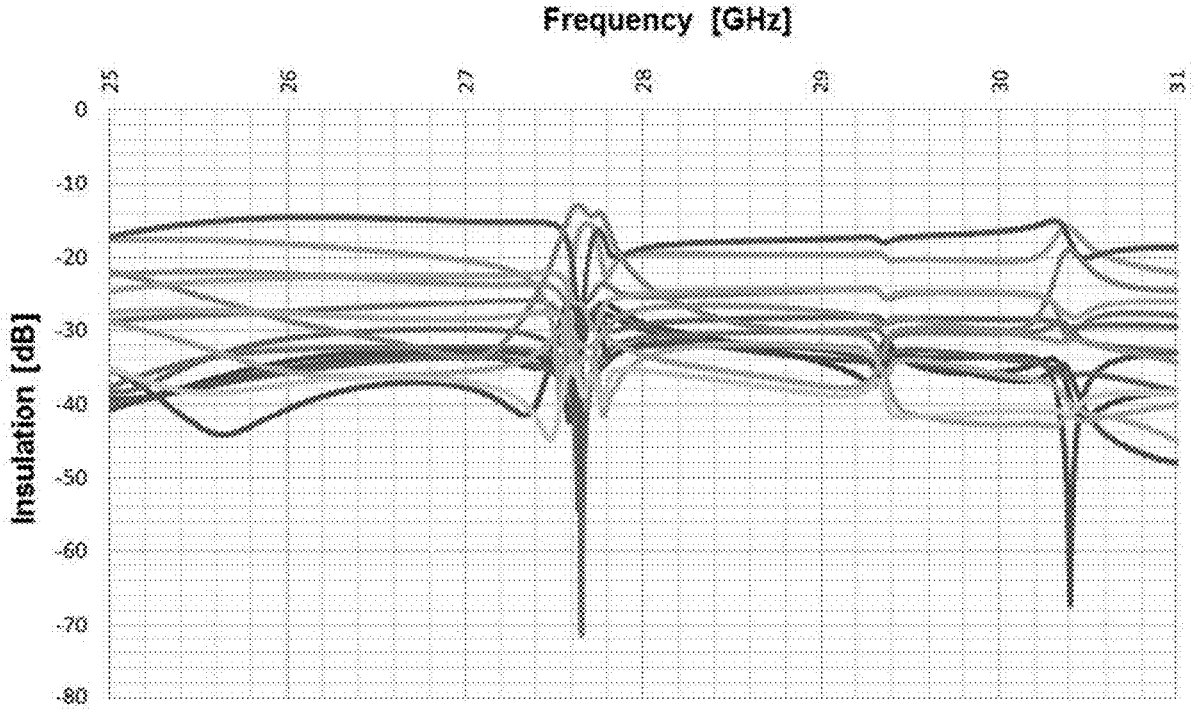

In the embodiment, by combining that shown as FIG. 11*a*, FIG. 11*b*, FIG. 12*a* and FIG. 12*b*, in which FIG. 11*a* and FIG. 11*b* are the curve graph of S parameter characteristics of the antenna system of FIG. 8, FIG. 11*a* is the curve graph of the reflection coefficient of all rectangular speaker in the antenna system. The reflection coefficient of all 16 rectangular speaker is less than −6 dB within the range of frequency channel 25.2 GHz-30 GHz, and full broadband exceeds 5 GHz.

FIG. 11*b* is the curve graph of insulation of one rectangular speaker with other fifteen rectangular speaker of antenna system. Within frequency range 25 GHz-31 GHz, insulation is kept under −12 dB. Under 28 GHz, insulation is lower than −18 dB.

Figure 12A:
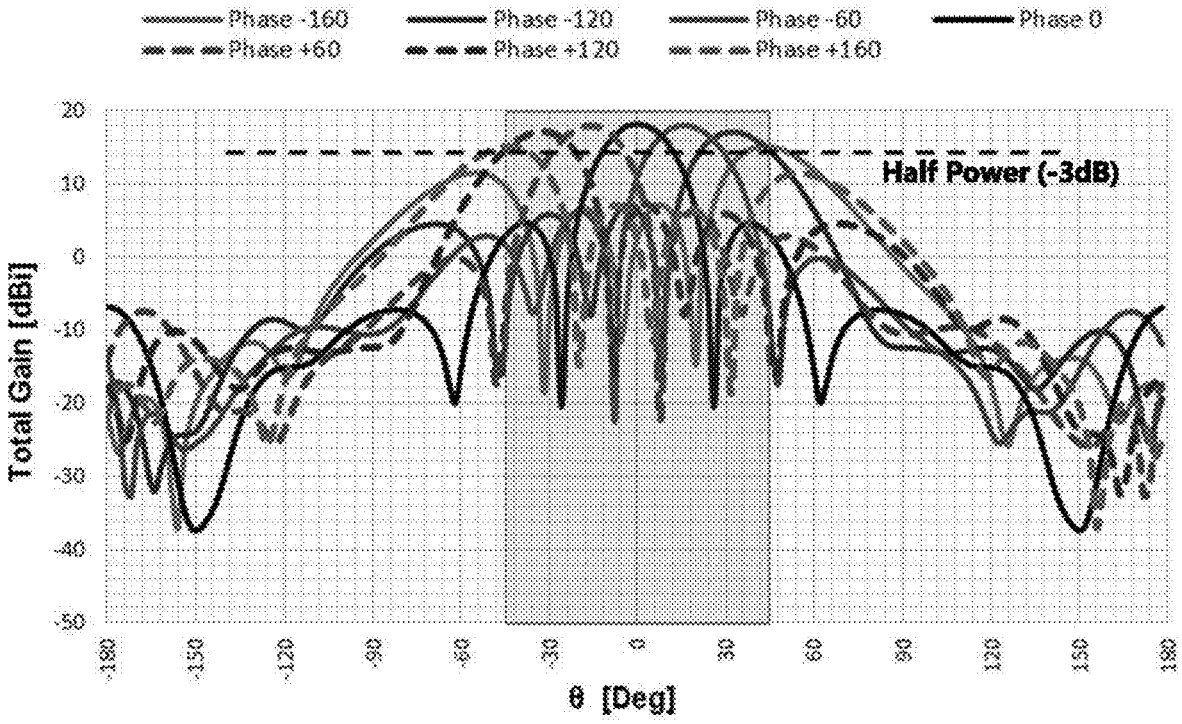
FIG. 12*a* and FIG. 12*b* are the gain curve graph in Phi=0° plane and Phi=90° plane when antenna system of FIG. 8 is in 28 GHz, and all rectangular speakers have phase differences.
Figure 12B:
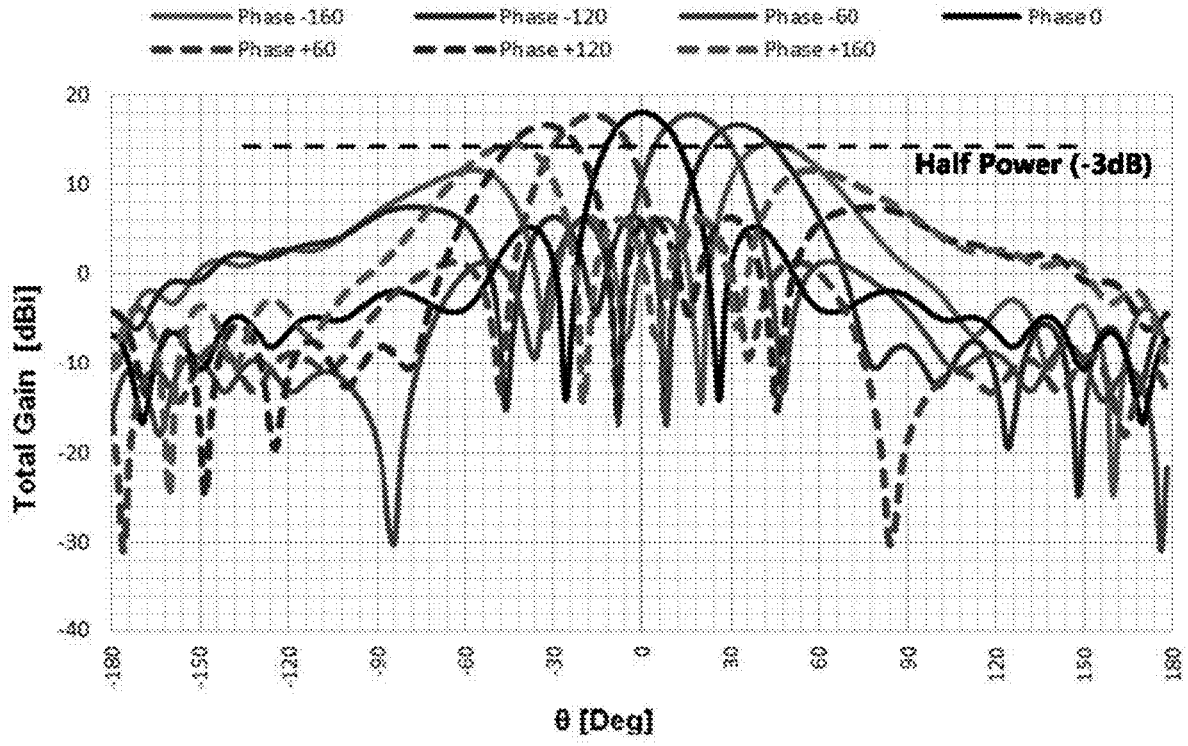

FIG. 12*a* and FIG. 12*b* are the gain curve graph when the antenna system of FIG. 8 is in 28 GHz, and all rectangular speaker have a phase difference. FIG. 12*a* is the gain curve graph in Phi=0° plane. FIG. 12*b* is the gain curve graph in Phi=90° plane. Phi=0° plane and Phi=90° plane are planes shown as FIG. 10.

Shown as FIG. 12*a*, when the phase difference among the corresponding rectangular speaker of the antenna system 800 are ±160°, ±120°, 60°, and 0°, the most significant gain is 18 dBi. The antenna system 800 can keep gain higher than 15 dBi within the scope from θ=−45° to θ=45° (total coverage 90°).

Shown as FIG. 12*b*, the largest gain is 18 dBi when the phase difference among the corresponding rectangular speaker of the antenna system 800 are ±160°, ±120°, ±60°, and 0°. Gain higher than 15 dBi is kept from θ=−42° to θ=42° (total coverage 84°).

In the antenna system of the invention, the subarray rectangular speaker element 10 also includes another embodiment, 8*8 rectangularly distributed millimeter phased-array antenna system structure.

In the embodiment the subarray rectangular speaker element 130 includes 16 subarray rectangular speaker element 130 are distributed in a matrix and interconnected electronically and forms 8*8 rectangularly distributed millimeter wave phased array antenna system structure. The subarray rectangular speaker element 130 is namely subarray rectangular speaker element 10 in the embodiment mentioned above.

Preferably, the metal base 1301 of sixteen subarray rectangular speaker element 130 is an integral structure. The circuit board 1302 of 16 subarray rectangular speaker element 130 is an integral structure. Sixteen phase-shifting unit 1303 are super imposed on sixteen circuit boards 1302 respectively. Sixteen speaker elements 1304 are super imposed on sixteen circuit board 1302 and connected electronically. The structures of the metal base 1301, the circuit board 1302, the phase-shifting unit 1303 and the speaker element 1304 are the same as that of the corresponding structure of subarray rectangular speaker element of above-mentioned 2*2 rectangularly distributed millimeter wave phased-array antenna system structure, so do not repeat here anymore.

Figure 13:
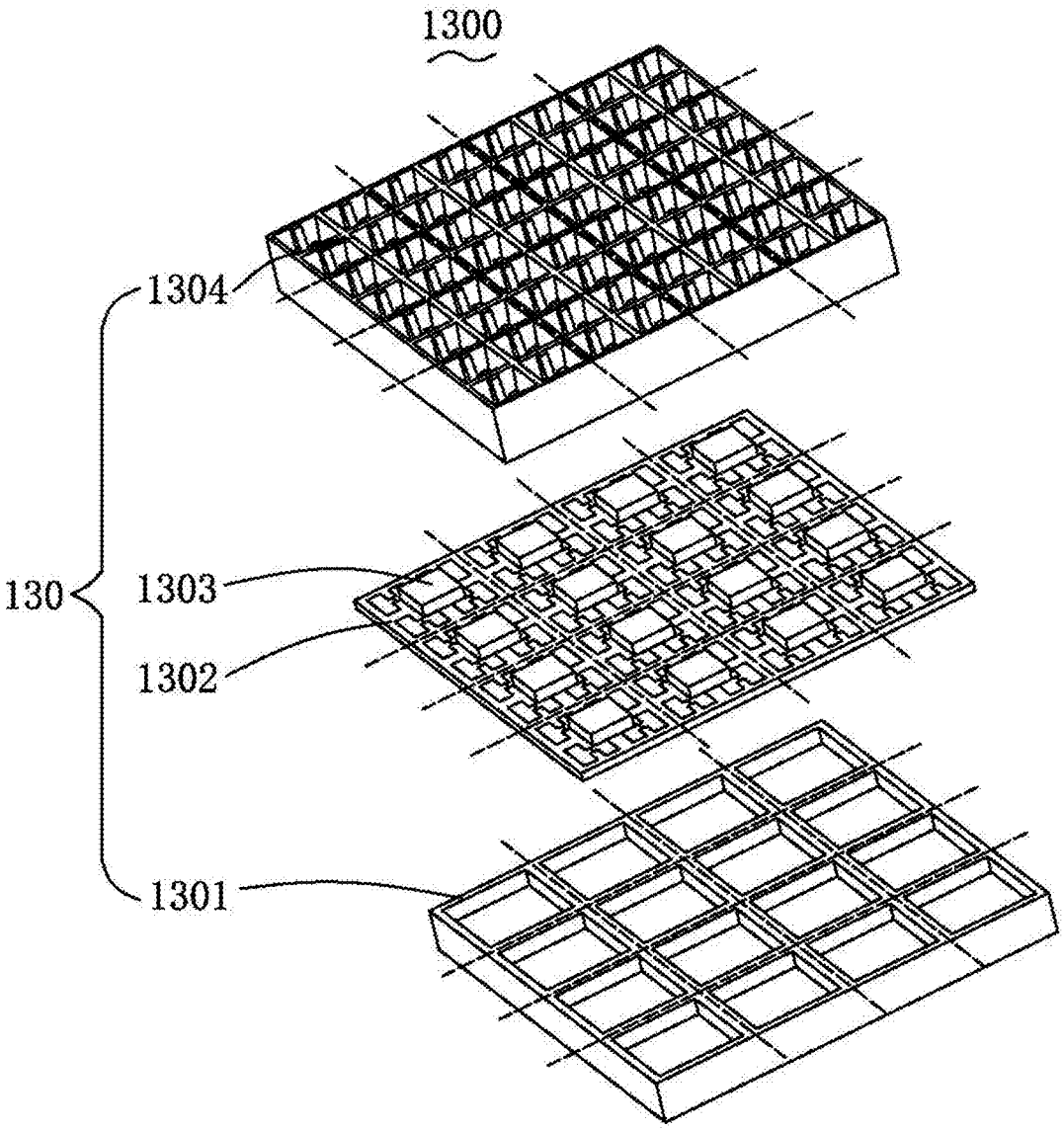
FIG. 13 is the decomposition graph of a three-dimensional structure of another embodiment of the antenna system of the invention.
Figure 14:
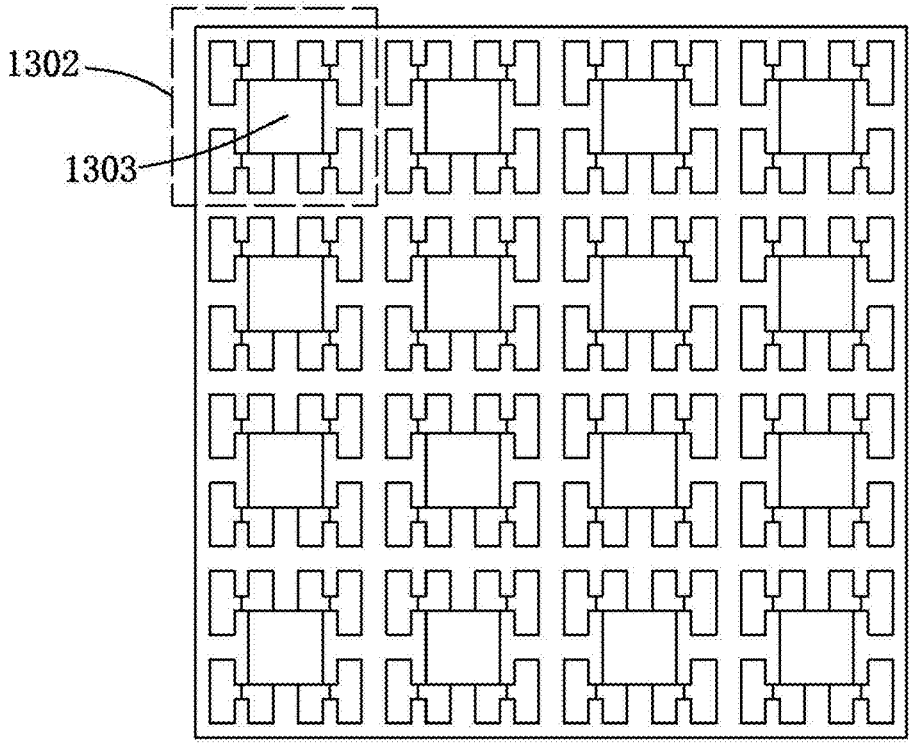
FIG. 14 is the vertical view of a partial structure of the antenna system of FIG. 13.
Figure 15:
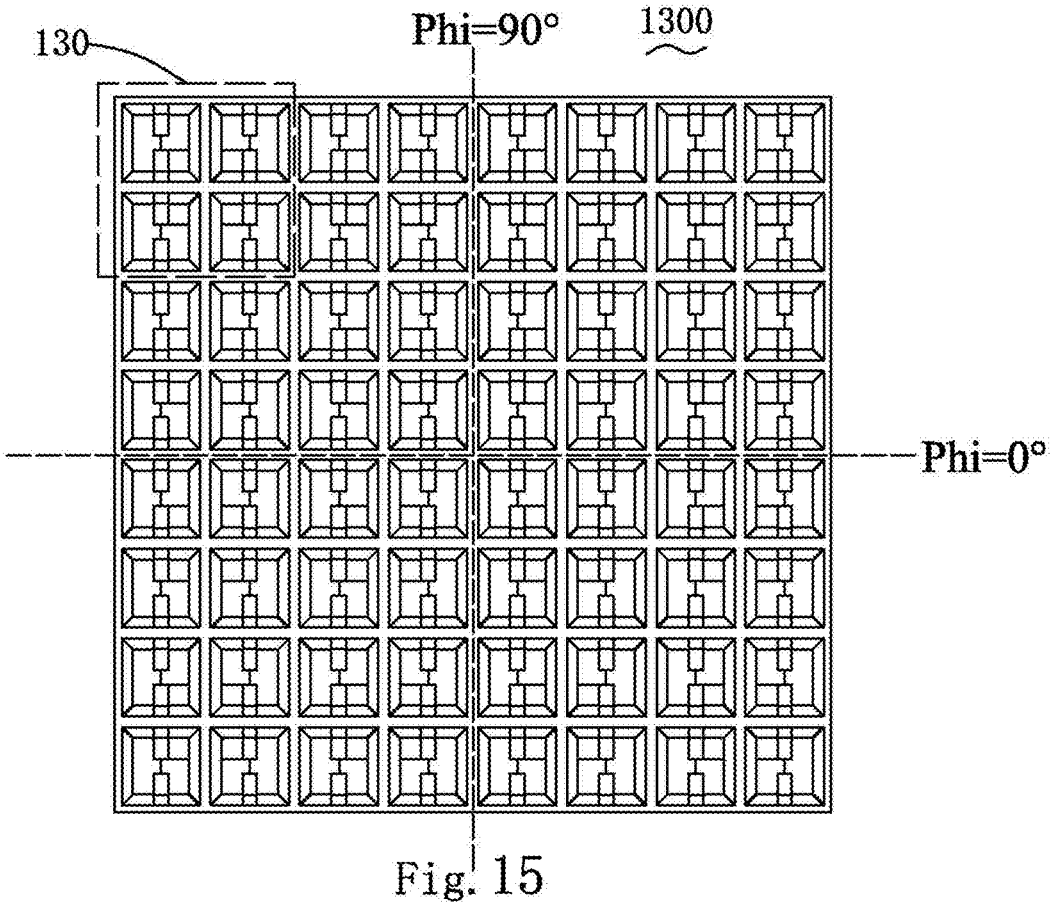
FIG. 15 is the structural vertical view of an antenna system of FIG. 13.
Figure 16A:
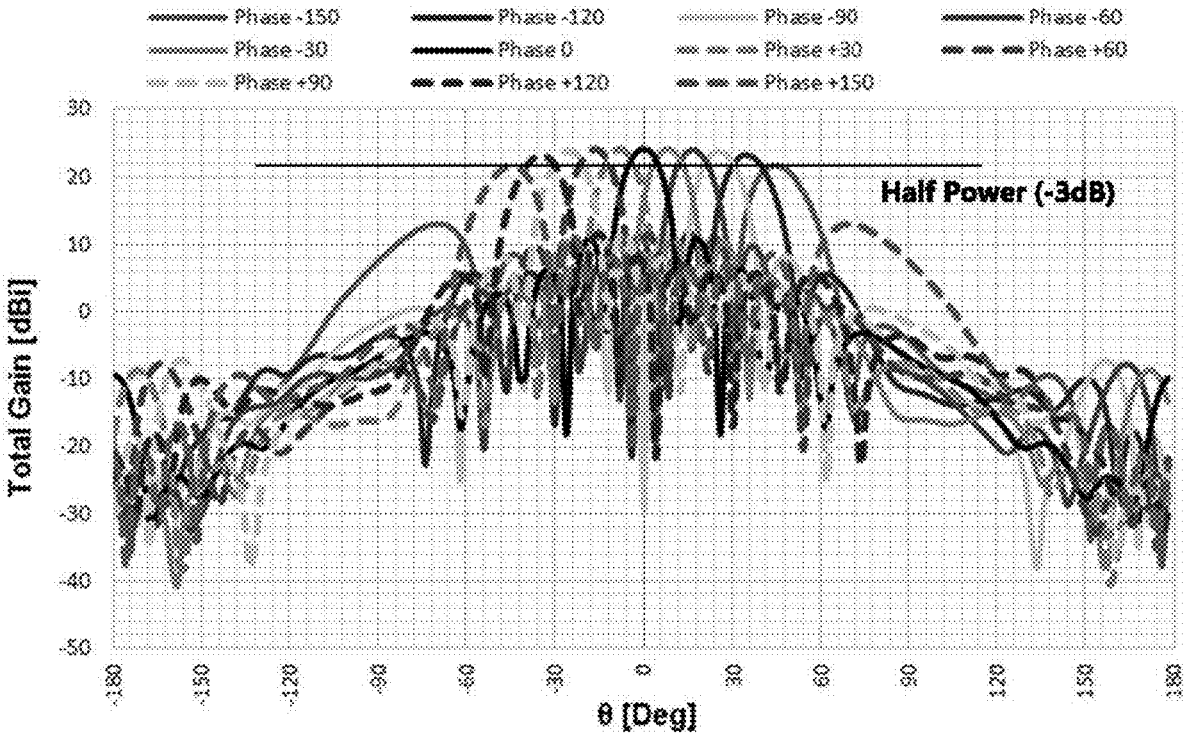
FIG. 16*a* and FIG. 16*b* are the antenna system of FIG. 13 in 28 GHz, and all rectangular speakers have phase differences, and the gain curve graph inside Phi=0° plane and Phi=90° plane.
Figure 16B:
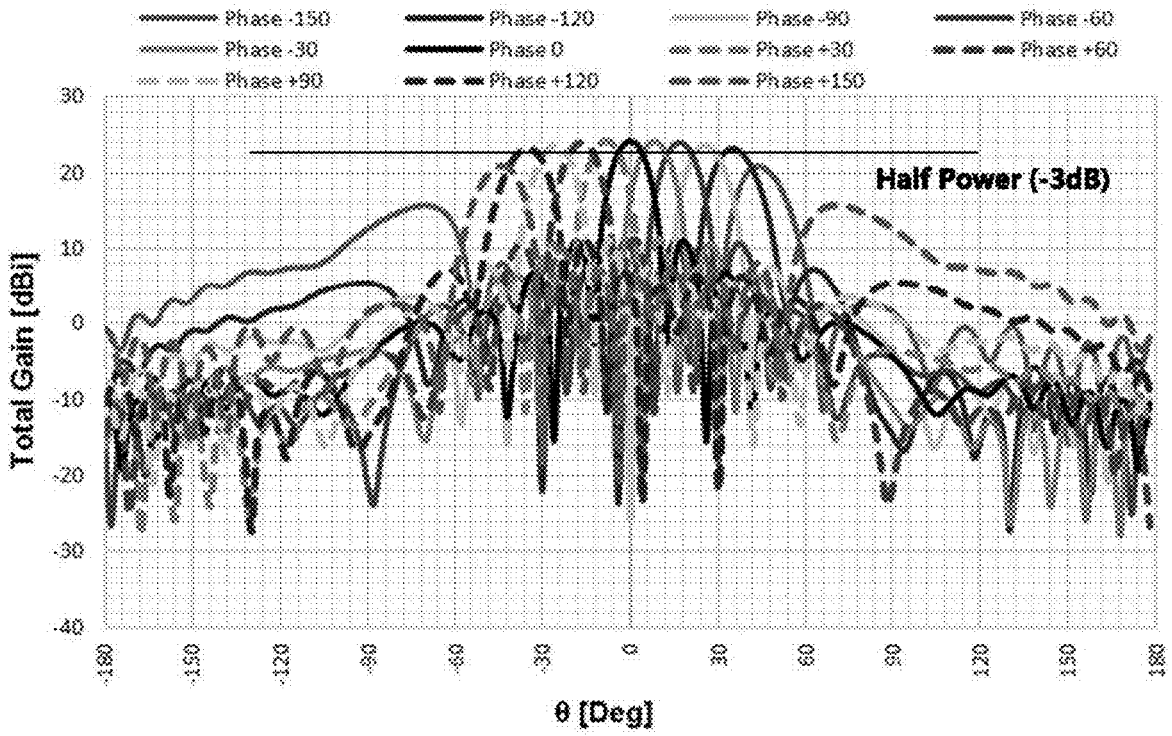

In the embodiment, shown as FIG. 16*a* and FIG. 16*b*, FIG. 16*a* and FIG. 16*b* are gain curve graph when the antenna system of FIG. 13 is in 28 GHz, and all rectangular speaker have a phase difference. FIG. 16*a* is the gain curve graph of Phi=0° plane. FIG. 16*b* is a gain curve graph of Phi=90° plane. Phi=0° plane and Phi=90° planes are the planes shown as FIG. 15. Shown as FIG. 16*a*, the largest gain is 24 dBi and antenna system 1300 can keep gain higher than 21 dBi Antenna system 1300 can keep gain higher than 21 dBi within the scope from θ=−45° to θ=45° (overall coverage 90°). When the phase differences among corresponding rectangular speakers of the antenna system 1300 are ±150°, ±120°, ±90°, ±60°, ±120°, and ±0°. Known as FIG. 16*b*, when the difference among corresponding rectangular speaker of the antenna system 1300 are ±150°, ±120°, ±90°, ±60°, ±30°, and 0°, the largest gain is 24 dBi. The antenna system can keep gain higher than 21 dBi from θ=−42° to θ=42° (total coverage is 84°).

It needs to explain that the quantity of the rectangular speaker element in the antenna system of the invention is not limited to one, four and sixteen and form a matrix arrangement for other quantity. The above-mentioned different embodiment is the different quantity of the rectangular speaker element. It is not limited to 16 matric rectangular speaker or 64 rectangular speaker element and but also forms rectangular speaker system of the phased array of larger size to reach total gain of the needed antenna system.

The invention also provides a communication terminal, which includes the above-mentioned antenna system provided by the invention.

Comparing with related technology, the antenna system in antenna system and communication terminal of the invention is designed into one or several sub-array rectangular speaker elements to form wave beam of high gain and make wave beam scan at larger space scope through phase-shifting change to ensure horizon communication between the transmitter of the antenna system and receiver not to be interrupted to make the communication signal of communication terminal using the antenna system strong, stable and have good reliability and covered range of frequency channel is wide.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An antenna system including a subarray rectangular speaker element, wherein the subarray rectangular speaker element includes:

a metal base with a cuboid structure, the metal base including a top surface and a bottom surface opposite to the top surface and a carinal cavity formed by depressing from the top surface to the bottom surface;

a circuit board superimposed on and connected electronically to the top surface of the metal base and covering the carinal cavity completely, the circuit board including four sub-circuit boards distributed in matrix and interconnected electronically, each one sub-circuit board including four conductive arms connected with each other for forming a rectangular ring, from which a first feed point end and a second feed point end extends;

a phase-shifting unit including a phase-shifting chip superimposed on the center of the circuit board and connected with the four sub-circuit boards electronically;

a speaker element including four matrix distributed rectangular speakers each being superimposed and fixed on one sub-circuit board; wherein the rectangular speakers are millimeter-wave antenna speakers; each rectangular speaker including four side walls and two ridges fixed respectively on two opposite inner side of the side walls that is superimposed and connected electronically on the conductive arms; the two ridges being superimposed and connected electronically on the first feed point end and the second feed point end; wherein the four conductive arms enclose and form a freeboard; the first feed point end and the second feed point end extends vertically respectively from the center of two opposite conductive arms toward the freeboard; the first feed point end and the second feed end interval form the feed port of the subarray rectangular speaker element; and two ends of the feed port respectively are connected with the first feed point end, and the second feed point end electronically.

2. The antenna system as described in claim 1, wherein external orthographic outlines of projections of the metal base and the speaker element on the circuit board are square-shaped, and coincide with an external orthographic outline of the circuit board.

3. The antenna system as described in claim 1, wherein the side wall of each rectangular speaker includes an external wall vertical to the circuit board and an inner wall with one end thereof adjacent to the circuit board expanding gradually toward another end far away from the circuit board to make a cross-sectional area of the side wall closing the circuit board larger than that far away from the circuit board.

4. The antenna system as described in claim 3, wherein an external outline enclosed by the inner wall of the rectangular speaker is square.

5. The antenna system as described in claim 3, wherein the ridge is fixed on the inner wall of the side wall, the ridge includes a fixed part connected with the sub-circuit board and an extension part extending from the fixed part to the side wall far away from one end of the circuit board; the extended part expands gradually from one end close to the fixed part to one end far away from the fixed part to make the cross-sectional area of the extension part close to one end of the fixed part larger than that of one end far away from the fixed part.

6. The antenna system as described in claim 1, wherein the phase-shifting unit further includes a metal shielding part covered and set on the phase-shifting chip completely, an escape part escaping the metal shielding part and arranged on the side wall of the rectangular speaker; and the metal shielding part is bound in the escape part and connected with the side wall.

7. The antenna system as described in claim 1, wherein the phase-shifting chip is a four-core phase-shifting chip.

8. The antenna system as described in claim 1, wherein the subarray rectangular speaker element includes form a matrix and are connected electronically and forms the antenna system of the phased array.

9. The antenna system as described in claim 8, wherein the metal base of the subarray rectangular speaker element is an integral forming structure; and the circuit board is an integral forming structure.

* * * * *